US008355018B2

(12) United States Patent
Rhodes et al.

(10) Patent No.: US 8,355,018 B2
(45) Date of Patent: Jan. 15, 2013

(54) INDEPENDENT PIXEL WAVEFORMS FOR UPDATING ELECTRONIC PAPER DISPLAYS

(75) Inventors: Bradley Rhodes, Alameda, CA (US); John W. Barrus, Menlo Park, CA (US); Guotong Feng, Mountain View, CA (US)

(73) Assignee: Ricoh Co., Ltd., Tokyo (JP)

( * ) Notice: Subject to any disclaimer, the term of this patent is extended or adjusted under 35 U.S.C. 154(b) by 878 days.

(21) Appl. No.: 12/059,399

(22) Filed: Mar. 31, 2008

(65) Prior Publication Data

US 2008/0309657 A1 Dec. 18, 2008

Related U.S. Application Data

(60) Provisional application No. 60/944,415, filed on Jun. 15, 2007.

(51) Int. Cl.
*G09G 5/00* (2006.01)

(52) U.S. Cl. ..... 345/214; 345/204; 345/211; 345/210

(58) Field of Classification Search ..... 345/55, 345/204, 210, 214, 690, 86–107; 359/296, 359/290, 267
See application file for complete search history.

(56) References Cited

U.S. PATENT DOCUMENTS

| | | | | |
|---|---|---|---|---|
| 4,065,770 | A * | 12/1977 | Berry | 342/185 |
| 4,930,875 | A * | 6/1990 | Inoue et al. | 345/97 |
| 5,029,257 | A * | 7/1991 | Kim | 315/169.4 |
| 5,122,791 | A * | 6/1992 | Gibbons et al. | 345/102 |
| 5,509,085 | A | 4/1996 | Kakutani | |
| 5,608,420 | A * | 3/1997 | Okada | 345/89 |
| 5,754,156 | A | 5/1998 | Erhart et al. | |
| 5,815,134 | A | 9/1998 | Nishi | |
| 5,963,714 | A | 10/1999 | Bhattacharjya et al. | |
| 6,067,185 | A | 5/2000 | Albert et al. | |
| 6,147,671 | A | 11/2000 | Agarwal | |
| 6,191,771 | B1 * | 2/2001 | Kondoh | 345/100 |
| 6,243,063 | B1 * | 6/2001 | Mayhew et al. | 345/94 |
| 6,327,017 | B2 | 12/2001 | Barberi et al. | |
| 6,504,524 | B1 | 1/2003 | Gates et al. | |
| 6,563,957 | B1 | 5/2003 | Li et al. | |
| 6,721,458 | B1 * | 4/2004 | Ancin | 382/261 |
| 6,738,039 | B2 * | 5/2004 | Goden | 345/107 |
| 6,791,716 | B1 | 9/2004 | Buhr et al. | |

(Continued)

FOREIGN PATENT DOCUMENTS

CN 1519620 8/2004

(Continued)

OTHER PUBLICATIONS

Bresenham, J.E., *Algorithm for Computer Control of a Digital Plotter*, IBM Systems Journal, 1965, pp. 25-30, vol. 4, No. 1.

(Continued)

*Primary Examiner* — Prabodh M Dharia
(74) *Attorney, Agent, or Firm* — Patent Law Works LLP

(57) ABSTRACT

A system and a method are disclosed for updating an image on a bi-stable display includes a module for determining a final optical state, estimating a current optical state and determining a sequence of control signals to produce a visual transition effect while driving the display from the current optical state toward a final optical state. The system also includes a control module for generating a control signal for driving the bi-stable display from the current optical state to the final optical state.

28 Claims, 5 Drawing Sheets

U.S. PATENT DOCUMENTS

| | | | | |
|---|---|---|---|---|
| 6,804,191 | B2 * | 10/2004 | Richardson | 370/208 |
| 6,850,217 | B2 * | 2/2005 | Huang et al. | 345/97 |
| 6,864,875 | B2 | 3/2005 | Drzaic et al. | |
| 6,901,164 | B2 | 5/2005 | Sheffer | |
| 7,012,600 | B2 | 3/2006 | Zehner et al. | |
| 7,075,502 | B1 | 7/2006 | Drzaic et al. | |
| 7,119,772 | B2 | 10/2006 | Amundson et al. | |
| 7,200,242 | B2 | 4/2007 | Murakami | |
| 7,280,103 | B2 | 10/2007 | Taoka et al. | |
| 7,372,594 | B1 | 5/2008 | Kusakabe et al. | |
| 7,456,808 | B1 | 11/2008 | Wedding et al. | |
| 7,528,882 | B2 | 5/2009 | Saori et al. | |
| 7,733,311 | B2 * | 6/2010 | Amundson et al. | 345/87 |
| 7,804,483 | B2 * | 9/2010 | Zhou et al. | 345/107 |
| 7,839,381 | B2 | 11/2010 | Zhou et al. | |
| 8,041,291 | B2 | 10/2011 | Hullot et al. | |
| 2002/0056805 | A1 * | 5/2002 | Bos et al. | 250/208.1 |
| 2003/0063575 | A1 | 4/2003 | Kinjo | |
| 2003/0095094 | A1 * | 5/2003 | Goden | 345/107 |
| 2003/0137521 | A1 | 7/2003 | Zehner et al. | |
| 2004/0002023 | A1 | 1/2004 | Sowinski | |
| 2004/0165115 | A9 | 8/2004 | Daly | |
| 2005/0013501 | A1 | 1/2005 | Kang et al. | |
| 2005/0116924 | A1 * | 6/2005 | Sauvante et al. | 345/108 |
| 2005/0174591 | A1 | 8/2005 | Sowinski et al. | |
| 2005/0179642 | A1 * | 8/2005 | Wilcox et al. | 345/107 |
| 2005/0248575 | A1 * | 11/2005 | Chou et al. | 345/473 |
| 2005/0280626 | A1 | 12/2005 | Amundson et al. | |
| 2005/0281334 | A1 | 12/2005 | Walker et al. | |
| 2006/0066503 | A1 | 3/2006 | Sampsell et al. | |
| 2006/0066595 | A1 | 3/2006 | Sampsell et al. | |
| 2006/0112382 | A1 | 5/2006 | Glass et al. | |
| 2006/0164405 | A1 | 7/2006 | Zhou | |
| 2006/0169980 | A1 | 8/2006 | Morita et al. | |
| 2006/0170648 | A1 * | 8/2006 | Zhou et al. | 345/107 |
| 2006/0250336 | A1 * | 11/2006 | Wood | 345/84 |
| 2007/0002009 | A1 | 1/2007 | Pasch et al. | |
| 2007/0013627 | A1 * | 1/2007 | Hsieh et al. | 345/89 |
| 2007/0052667 | A1 * | 3/2007 | Zhou et al. | 345/107 |
| 2007/0057905 | A1 * | 3/2007 | Johnson et al. | 345/107 |
| 2007/0057906 | A1 | 3/2007 | Johnson et al. | |
| 2007/0075949 | A1 * | 4/2007 | Lu et al. | 345/89 |
| 2007/0085819 | A1 | 4/2007 | Zhou et al. | |
| 2007/0087756 | A1 * | 4/2007 | Hoffberg | 455/450 |
| 2007/0140351 | A1 | 6/2007 | Ho | |
| 2007/0205978 | A1 | 9/2007 | Zhou et al. | |
| 2007/0206262 | A1 * | 9/2007 | Zhou | 359/267 |
| 2008/0084600 | A1 * | 4/2008 | Bita et al. | 359/290 |
| 2008/0111778 | A1 | 5/2008 | Shen et al. | |
| 2008/0135412 | A1 | 6/2008 | Cortenraad et al. | |
| 2008/0198098 | A1 | 8/2008 | Gelbman et al. | |
| 2008/0291129 | A1 | 11/2008 | Harris et al. | |
| 2011/0285754 | A1 * | 11/2011 | Harrington et al. | 345/690 |

FOREIGN PATENT DOCUMENTS

| | | | |
|---|---|---|---|
| CN | 1577471 | | 2/2005 |
| CN | 1589462 | | 3/2005 |
| JP | 02-136915 | A | 5/1990 |
| JP | 2003-256134 | A | 9/2003 |
| JP | 2006-243364 | A | 9/2006 |
| JP | 2006243364 | | 9/2006 |
| JP | 2007-102042 | A | 4/2007 |
| JP | 2007-241405 | A | 9/2007 |
| TW | 200504442 | | 2/2005 |
| WO | WO 03/044765 | A2 | 5/2003 |
| WO | WO 2004/034366 | A1 | 4/2004 |
| WO | 2005006296 | | 1/2005 |
| WO | WO 2005/027087 | A1 | 3/2005 |
| WO | WO 2005/073949 | | 8/2005 |
| WO | WO 2005/078692 | A1 | 8/2005 |
| WO | WO 2005/086131 | A1 | 9/2005 |
| WO | 2005101362 | | 10/2005 |
| WO | WO 2005/093705 | A1 | 10/2005 |
| WO | WO 2005/096259 | A1 | 10/2005 |
| WO | WO 2005/101362 | A1 | 10/2005 |
| WO | WO 2006/013502 | A1 | 2/2006 |
| WO | WO 2006064459 | * | 6/2006 |
| WO | WO 2007/099829 | A1 | 9/2007 |
| WO | WO 2007/135594 | | 11/2007 |

OTHER PUBLICATIONS

Crowley, J.M. et al., *Dipole Moments of Gyricon Balls*, Electrostatics Fundamentals. Applications and Hazards, Selected Papers from the Fourth IEJ-ESA Joint Symposium on Electrostatics, Sep. 25-26, 2000, pp. 247-259, vol. 55, No. 3-4.

Zehner, R. et al., *Drive Waveforms for Active Matrix Electrophoretic Displays*, May 2003, pp. 842-845, vol. XXXIV, Book II.

PCT International Search Report and Written Opinion, PCT/JP2008/061277, Aug. 19, 2008, 11 pages.

PCT International Search Report and Written Opinion, PCT/JP2008/061273, Sep. 16, 2008, 11 pages.

PCT International Search Report and Written Opinion, PCT/JP2008/061272, Sep. 30, 2008, 10 pages.

PCT International Search Report and Written Opinion, PCT/JP2008/061271, Sep. 30, 2008, 11 pages.

PCT International Search Report and Written Opinion, PCT/JP2008/061278, Oct. 7, 2008, 11 pages.

United States Office Action, U.S. Appl. No. 12/059,091, Jul. 27, 2011, 24 pages.

United States Office Action, U.S. Appl. No. 12/059,441, Aug. 12, 2011, 12 pages.

Extended European Search Report, European Patent Application No. EP08777423, Jun. 7, 2011, 12 pages.

Chinese Office Action, Chinese Application No. 200880000725.3, Jun. 29, 2011, 9 pages.

Chinese Office Action, Chinese Patent Application No. 200880000556.3, Apr. 8, 2011, 9 pages.

U.S. Office Action, U.S. Appl. No. 12/059,441, Apr. 20, 2011, 11 pages.

U.S. Office Action, U.S. Appl. No. 12/059,085, May 13, 2011, 13 pages.

United States Office Action, U.S. Appl. No. 12/059,118, Sep. 14, 2011, 54 pages.

United States Office Action, U.S. Appl. No. 12/059,091, Oct. 19, 2011, 32 pages.

Chinese Office Action, Chinese Application No. 200880000556.3, Aug. 1, 2011, 10 pages.

Japanese Office Action, Japanese Patent Application No. 2009-506841, Dec. 6, 2011, 2 pages.

U.S. Office Action, U.S. Appl. No. 12/415,899, Nov. 8, 2011, 27 pages.

U.S. Office Action, U.S. Appl. No. 12/059,085, Nov. 14, 2011, 21 pages.

U.S. Office Action, U.S. Appl. No. 12/059,441, Dec. 2, 2011, 29 pages.

U.S. Office Action, U.S. Appl. No. 12/059,118, Jan. 11, 2012, 23 pages.

JP Office Action, JP Patent Application No. 097122474, Feb. 23, 2012, 10 pgs.

EPO Communication, EP Patent Application No. 08 765 765.6-2205, Apr. 25, 2012, 9 pages.

U.S. Office Action, U.S. Appl. No. 12/415,899, Mar. 29, 2012, 32 pages.

U.S. Office Action, U.S. Appl. No. 12/059,441, Mar. 29, 2012, 22 pages.

U.S. Notice of Allowance, U.S. Appl. No. 12/059,118, Apr. 9, 2012, 19 pages.

* cited by examiner

INDEPENDENT PIXEL WAVEFORMS FOR UPDATING ELECTRONIC PAPER DISPLAYS

CROSS REFERENCE TO RELATED APPLICATIONS

This application claims the benefit of U.S. Provisional Patent Application No. 60/944,415, filed Jun. 15, 2007, entitled "Systems and Methods for Improving the Display Characteristics of Electronic Paper Displays," the contents of which are hereby incorporated by reference in its entirety.

BACKGROUND

1. Field of Art

The disclosure generally relates to the field of electronic paper displays. More particularly, the invention relates to updating electronic paper displays.

2. Description of the Related Art

Several technologies have been introduced recently that provide some of the properties of paper in a display that can be updated electronically. Some of the desirable properties of paper that this type of display tries to achieve include: low power consumption, flexibility, wide viewing angle, low cost, light weight, high resolution, high contrast, and readability indoors and outdoors. Because these displays attempt to mimic the characteristics of paper, they are referred to as Electronic Paper Displays (EPDs) in this application. Other names for this type of display include: paper-like displays, zero power displays, e-paper and bi-stable displays.

A comparison of EPDs to Cathode Ray Tube (CRT) displays or Liquid Crystal Displays (LCDs) reveals that in general, EPDs require much less power and have higher spatial resolution, but have the disadvantages of lower update rates, less accurate gray level control, and lower color resolution. Many electronic paper displays are currently only grayscale devices. Color devices are becoming available often through the addition of a color filter, which tends to reduce the spatial resolution and the contrast.

Electronic Paper Displays are typically reflective rather than transmissive. Thus they are able to use ambient light rather than requiring a lighting source in the device. This allows EPDs to maintain an image without using power. They are sometimes referred to as "bi-stable" because black or white pixels can be displayed continuously, and power is only needed when changing from one state to another. However, many EPD devices are stable at multiple states and thus support multiple gray levels without power consumption.

The low power usage of EPDs makes them especially useful for mobile devices where battery power is at a premium. Electronic books are a common application for EPDs in part because the slow update rate is similar to the time required to turn a page, and therefore is acceptable to users. EPDs have similar characteristics to paper, which also makes electronic books a common application.

While electronic paper displays have many benefits there are disadvantages. One problem, in particular, is known as ghosting. Ghosting refers to the visibility of previously displayed images in a new or subsequent image. An old image can persist even after the display is updated to show a new image, either as a faint positive (normal) image or as a faint negative image (where dark regions in the previous image appear as slightly lighter regions in the current image). This effect is referred to as "ghosting" because a faint impression of the previous image is still visible. The ghosting effect can be particularly distracting with text images because text from a previous image may actually be readable in the current image. A human reader faced with "ghosting" artifacts has a natural tendency to try to decode meaning making displays with ghosting very difficult to read.

One method for reducing error, therefore reducing ghosting, is to apply enough voltage over a long period of time to saturate the pixels to either pure black or pure white before bringing the pixels to their desired reflectance. FIG. 1 illustrates a prior art technique for updating an electronic paper display. Here, display control signals (waveforms) are used that do not bring each pixel to the desired final value immediately. The original image 110 is a large letter 'X' rendered in black on a white background. First, all the pixels are moved toward the white state as shown by the second image 112, then all the pixels are moved toward the black state as shown in a third image 114, then all the pixels are again moved toward the white state as shown in the fourth image 116, and finally all the pixels are moved toward their values for the next desired image as shown in the resulting image 118. Here, the next desired image is a large letter 'O' in black on a white background. Because of all the intermediate steps this process takes much longer than the direct update. However, moving the pixels toward white and black states tends to remove some, but not all, of the ghosting artifacts.

Setting pixels to white or black values helps to align the optical state because all pixels will tend to saturate at the same point regardless of the initial state. Some prior art ghost reduction methods drive the pixels with more power than should be required in theory to reach the black state or white state. The extra power insures that regardless of the previous state a fully saturated state is obtained. In some cases, long term frequent over-saturation of the pixels may lead to some change in the physical media, which may make it less controllable.

One of the reasons that the prior art ghosting reduction techniques are objectionable is that the artifacts in the current image are meaningful portions of a previous image. This is especially problematic when the content of both the desired and current image is text. In this case, letters or words from a previous image are especially noticeable in the blank areas of the current image. For a human reader, there is a natural tendency to try to read this ghosted text, and this interferes with the comprehension of the current image. Prior art ghosting reduction techniques attempt to reduce these artifacts by minimizing the difference between two pixels that are supposed to have the same value in the final image.

Another reason that the prior art technique described above is objectionable is because it produces a flashing appearance as the images change from one image to the next. The flashing can be quite obtrusive to an observer and gives a "slide show" presentation quality to the image change.

It would therefore be highly desirable to have a method for updating an electronic paper display where the error in the subsequent image is reduced, thus displaying less "ghosting" artifacts when a new image is updated on the display screen, without the undesirable and interruptive effect when transitioning from one image to the next.

SUMMARY

One embodiment of a system for updating an image on a bi-stable display includes a module for determining a final optical state, estimating a current optical state and determining a sequence of control signals to produce a visual transition effect while driving the display from the current optical state toward a final optical state. The system also includes a control module for generating a control signal for driving the bi-stable display from the current optical state to the final optical state.

One embodiment of a method for updating a bi-stable display includes determining a desired optical state and estimating a current optical state. The method also includes applying a direct drive to the current image in order to display the desired image. The method further includes applying a sequence of control signals to produce a visual transition effect while driving the display from the current optical state toward a final optical state.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the disclosed subject matter.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

Figure 1:
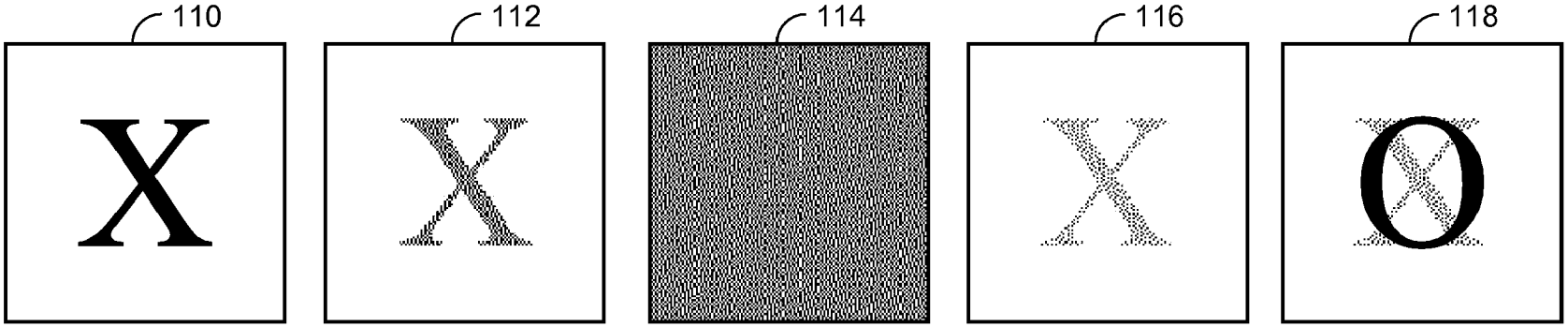
FIG. 1 Prior Art
FIG. 1 illustrates graphic representations of successive frames generated by a prior art technique for reducing the ghosting artifacts.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

As used herein any reference to "one embodiment," "an embodiment," or "some embodiments" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article or apparatus that comprises a list of elements is not necessarily limited to only those elements but may include other elements not expressly listed or inherent to such process, method, article or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Exemplary Model of an Electronic Paper Display

Figure 2:
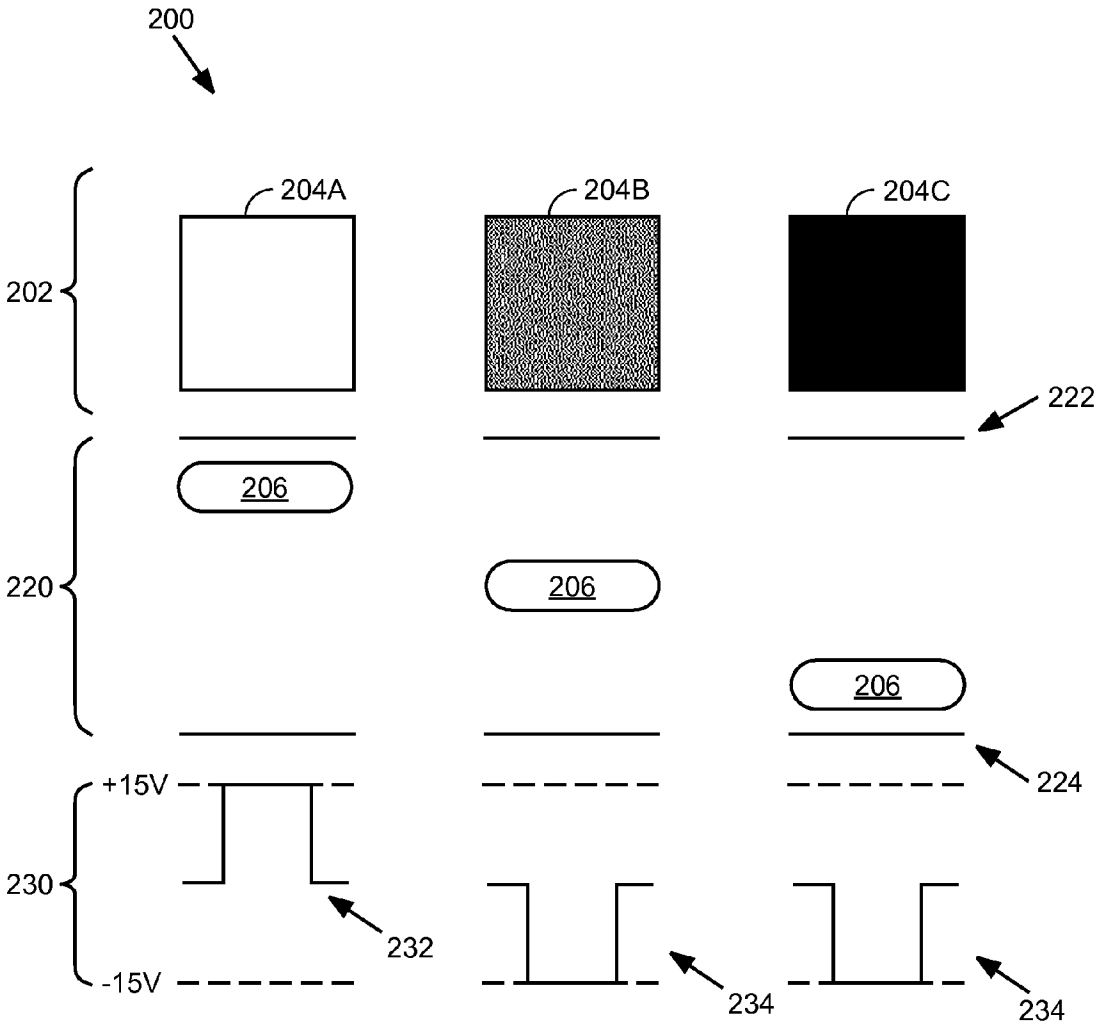
FIG. 2 illustrates a model of a typical electronic paper display in accordance with some embodiments.

FIG. 2 illustrates a model 200 of a typical electronic paper display in accordance with some embodiments. The model 200 shows three parts of an Electronic Paper Display: a reflectance image 202; a physical media 220 and a control signal 230. To the end user, the most important part is the reflectance image 202, which is the amount of light reflected at each pixel of the display. High reflectance leads to white pixels as shown on the left (204A), and low reflectance leads to black pixels as shown on the right (204C). Some Electronic Paper Displays are able to maintain intermediate values of reflectance leading to gray pixels, shown in the middle (204B).

Electronic Paper Displays have some physical media capable of maintaining a state. In the physical media 220 of electrophoretic displays, the state is the position of a particle or particles 206 in a fluid, e.g. a white particle in a dark fluid. In other embodiments that use other types of displays, the state might be determined by the relative position of two fluids, or by rotation of a particle or by the orientation of some structure. In FIG. 2, the state is represented by the position of the particle 206. If the particle 206 is near the top (222), white state, of the physical media 220 the reflectance is high, and the pixels are perceived as white. If the particle 206 is near the bottom (224), black state, of the physical media 220, the reflectance is low and the pixels are perceived as black.

Regardless of the exact device, for zero power consumption, it is necessary that this state can be maintained without any power. Thus, the control signal 230 as shown in FIG. 2 must be viewed as the signal that was applied in order for the physical media to reach the indicated position. Therefore, a control signal with a positive voltage 232 is applied to drive the white particles toward the top (222), white state, and a control signal with a negative voltage 234 is applied to drive the black particles toward the top (222), black state.

The reflectance of a pixel in an EPD changes as voltage is applied. The amount the pixel's reflectance changes may depend on both the amount of voltage and the length of time for which it is applied, with zero voltage leaving the pixel's reflectance unchanged.

Method Overview

Figure 3:
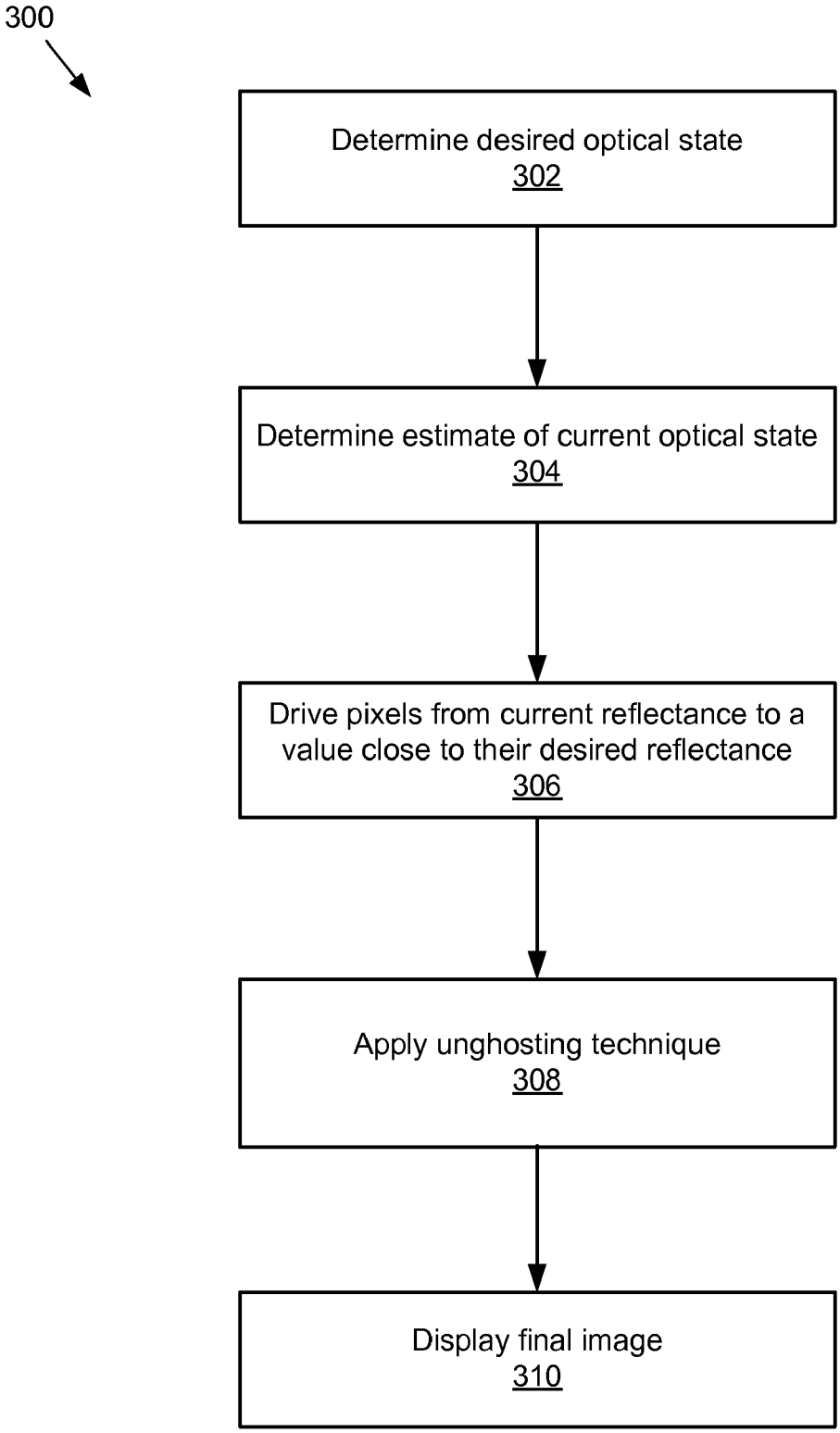
FIG. 3 illustrates a high level flow chart of a method for updating a bi-stable display in accordance with some embodiments.

FIG. 3 illustrates a high level flow chart of a method 300 for updating a bi-stable display in accordance with some embodiments. First, the desired optical state is determined 302. In some embodiments, the desired optical state is an image received from an application consisting of a desired pixel value for every location of the display. In another embodiment, the desired optical state is an update to some region of the display. The voltage amount needed to drive the display from the current image to a final image is determined. Next, an estimate of the current optical state is determined 304. In some embodiments, the current optical state is simply assumed to be the previously desired optical state. In other embodiments, the current optical state is determined from a sensor, or estimated from the previous control signals and some model of the physics of the display.

Next, pixels are driven directly from the current reflectance to a value close to their desired reflectance 306 by applying voltage to each pixel in the current image over an appropriate amount of time to quickly approximate the new value of the pixel in the desired image. In some embodiments, this transition is accomplished by using a constant voltage and applying that voltage over a certain period of time to achieve the desired reflectance. For example, a voltage of −15V might be applied for 300 milliseconds (ms) to change a pixel from white to black, while a voltage of +15V might be applied for 140 ms to change a pixel from grey to white. At the end of this direct drive step, the desired image will be visible on the display, but will also contain errors (and particularly ghosting artifacts) due to uncertainty about the exact reflectance value of each pixel in the original image and due to lack of sufficient granularity in the voltages and voltage durations that can be applied. In an alternate embodiment, a voltage of −15V might be applied for 300 milliseconds (ms) to change a pixel from black to white, while a voltage of +15V might be applied for 140 ms to change a pixel from white to grey.

Therefore, to achieve a final image with reducing ghosting artifacts and to produce a more visually pleasing transition state from the current image to the desired image, a deghosting technique is applied 308. Each pixel is labeled with a number ranging from 1 to N. In some embodiments, N=16 and each pixel is stochastically labeled such that its label is not likely to be close to any of the labels on neighboring pixels. Because pixel labels depend only on position, in some embodiments, the labels can be computed in advance and can be represented as an image file containing random noise that has been filtered to avoid clustering. In other embodiments, the label pattern could also be created by tiling a pre-computed filtered-noise pattern. In yet other embodiments, labels can be computed on the fly. Many filtered-noise algorithms can be employed. In other embodiments, non-filtered noise can also be employed.

Once the pixels are labeled, updated waveforms (sequences of voltages) are applied to each pixel, with a different waveform applied for each label. These waveforms consist of an onset delay, followed by a deghosting sequence that is designed to reduce the amount of error in the pixel's reflectance without changing the pixel's nominal grey value. In some embodiments, the waveforms applied to pixels for each label are the standard waveforms that saturate the pixel to white, then black, then back to white, and then bring finally it back to the initial starting value again, but with onset delays such that each offset time differs from its neighboring labels a certain amount of time. For example, if the offset time is 80 ms, the pixels with label 1 start their transition waveform. And then, 80 ms later, the next pixels would have their transition waveform.

To illustrate this effect, below is a table of exemplary labels and assigned offsets.

| Label | Offset (ms) |
|---|---|
| 1 | 0 |
| 2 | 80 |
| 3 | 160 |
| 4 | 240 |
| 5 | 320 |
| 6 | 400 |
| 7 | 480 |
| 8 | 560 |
| 9 | 640 |
| 10 | 720 |
| 11 | 800 |
| 12 | 880 |
| 13 | 960 |
| 14 | 1040 |
| 15 | 1120 |
| 16 | 1200 |

In the above exemplary table, each pixel labeled "1" would start their transitioning waveform at time zero. Pixels labeled "2" would start their transitioning waveforms 80 ms after the pixels labeled "1" have started. Pixels labeled "3" would start their transitioning waveforms 80 ms after the pixels labeled "2" have started, or 160 ms after the pixels labeled "1" have started.

In some embodiments, standard waveforms supplied by certain electronic paper displays last for only a certain period of time. For example, standard waveforms supplied by some electronic paper displays last for 720 ms. Therefore, given the above exemplary table, pixels labeled "2" through "7" will still be in the process of displaying when the waveform for the pixels labeled "1" have finished its complete sequence.

In some embodiments, labels are not randomly chosen, but are chosen to produce an animated transition from one image to the next. In some embodiments, the labeling of pixels and sequences of voltages chosen produces various visual effects during the transition from one image to the next image. For example, as mentioned above, in some embodiments, the labeling of pixels and sequences of voltages chosen produces an appearance such that the current image first changes quickly to the next image, followed by a period of what might look like TV static over the entire screen, during which any ghosting artifacts disappear. In other embodiments, the "direct drive" phase is skipped and the time-offset voltage sequences are chosen such that they both reduce ghosting artifacts and drive pixels to their desired values. In these embodiments, the labeling of pixels and sequences of voltages chosen produces a sparkling visual effect that starts at the top of the screen and continues to the bottom of the screen. As the sparkling line sweeps down the screen, pixels change from their old values to their new values, giving a "wipe" effect as might be seen when changing to a new slide in a PowerPoint presentation. In yet other embodiments, the labeling of pixels and sequences of voltages chosen produces a sparkling visual effect that starts at the bottom of the screen and continues to the top of the screen. In some other embodiments, the labeling of pixels and sequences of voltages chosen produces a sparkling visual effect that starts at the right of the screen and continues to the left of the screen. In some other embodiments, the labeling of pixels and sequences of voltages chosen produces a sparkling visual effect that starts at the left of the screen and continues to the right of the screen. In another embodiment, the labeling of pixels and sequences of voltages chosen produces a sparkling visual effect that starts a top corner of the screen and continues to the opposite corner of the screen. In another embodiment, the labeling of pixels and sequences of voltages chosen produces a sparkling visual effect that starts a bottom corner of the screen and continues to the opposite corner of the screen.

Once the pixels have all gone through their appropriate waveform updates, the final image is displayed 310. The steps described above help in reducing error and this ghosting on an electronic paper display without the undesirable perceived flashing by producing a more pleasant visual transition from the current image to the next desired image. The reduction in the perceived flashing comes from temporarily offsetting each pixel's waveform from those of its neighbors as described above by the "random" labeling method. The overall effect is perceived as random-noise interference (much like static on a television screen) rather than a disruptive flashing image. This "sparkling" type of effect is less distracting and resembles the appearance of the current image dissolving and transitioning into the desired image.

Figure 4:
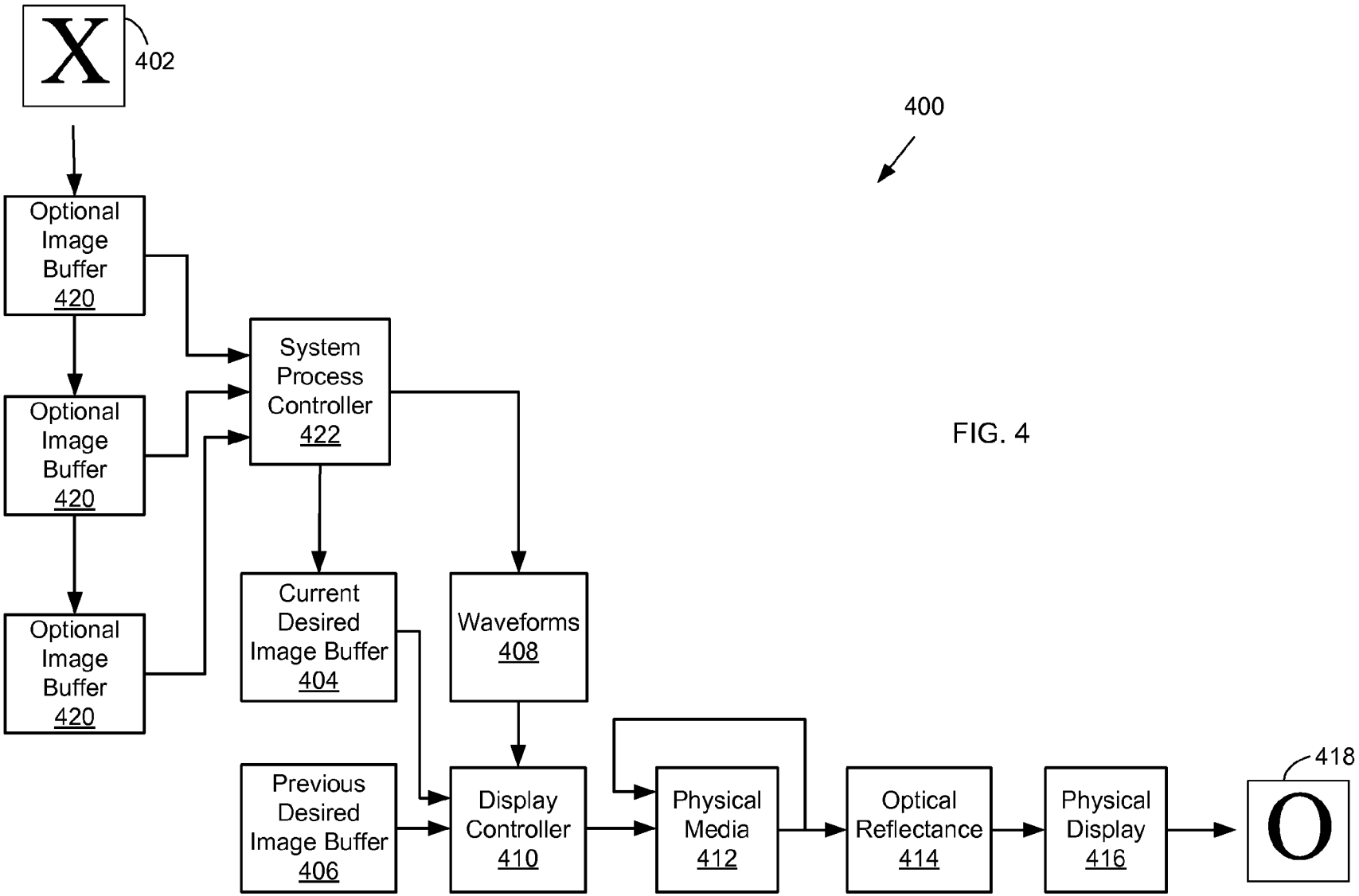
FIG. 4 illustrates a block diagram of an electronic paper display system in accordance with some embodiments.

FIG. 4 illustrates a block diagram of an electronic paper display system in accordance with some embodiments. Data 402 associated with a desired image, or first image, is provided into the system 400.

The system 400 includes a system process controller 422 and some optional image buffers 420. In some embodiments, the system includes a single optional image buffer. In other embodiments, the system includes multiple optional image buffers as shown in FIG. 4.

In some embodiments, the waveforms used in the system of FIG. 4 are modified by the system process controller 422. In some embodiments, the desired image provided to the rest of the system 400 is modified by the optional image buffers 502 and system process controller 422 because of knowledge about the physical media 412, the image reflectance 414, and how a human observer would view the system. It is possible to integrate many of the embodiments described here into the display controller 410, however, in this embodiment, they are described separately operating outside of FIG. 4.

The system process controller 422 and the optional image buffers 420 keep track of previous images, desired future images, and provide additional control that may not be possible in the current hardware. The system process controller 422 and the optional image buffers 420 also determine and store the pixel labels.

A filtered noise image file is generated. Each pixel is probabilistically set to a value between 0 and 15 with higher probability given to values that are far away from the value of neighboring pixels. In some embodiments, this filtered noise image file is generated once and used for each application of the method 300 for updating a bi-stable display.

The desired image data 402 is then sent and stored in current desired image buffer 404 which includes information associated with the current desired image. The previous desired image buffer 406 stores at least one previous image in order to determine how to change the display 416 to the new desired image. The previous desired image buffer 406 is coupled to receive the current image from the current desired image buffer 404 once the display 416 has been updated to show the current desired image.

The waveform storage 408 is for storing a plurality of waveforms. A waveform is a sequence of values that indicate the control signal voltage that should be applied over time. The waveform storage 408 outputs a waveform responsive to a request from the display controller 410. There are a variety of different waveforms, each designed to transition the pixel from one state to another depending on the value of the previous pixel, the value of the current pixel, and the time allowed for transition.

In some embodiments, two waveform files are generated. One waveform file is used in the direct drive phase, while the other waveform file is used in the deghosting phase. In some embodiments, this waveform file encodes a three-dimensional array, the first two axes being the previous pixel value and the desired pixel value (both down-sampled to a value from 0 to 15), and the third axis being the frame number, with one frame occurring every 20 milliseconds.

The direct-drive waveform file applies voltage to a pixel for a number of frames equal to the desired value minus the previous value. In some embodiments, a negative value indicating negative voltage. For example, in some embodiments, to transition from a white reflectance (15) to a dark grey reflectance (4), the waveform would apply −15V for 9 frames, which is equal to 180 milliseconds.

Typically, the controller would receive a previous image, a desired image and a waveform file and from this, the controller would decide what voltage sequences to apply. Since a direct-drive update has been previously performed in step 306 (FIG. 3), the previous image and the desired image will be the same. Therefore, the filtered-noise image file is instead sent to the display controller 410 as the desired image. In some embodiments, a waveform file may be sent to the controller as a table where the table includes information about the previous image, information about the desired image, and the frame numbers. In this instance, a look-up is performed to determine what voltage to apply. With a normal waveform file, this would display the random-noise image, but the deghost waveform file has been written such that all the voltage sequences it produces result in going through an deghosting waveform and then back to the original pixel value, regardless of what desired value is specified. The desired value axis is instead used to select the temporal-offset for when a particular waveform starts. As a final phase, the display is updated with the actual desired image but with a null waveform that applies no voltage so that the previous desired image buffer 406 is reset to the correct value rather than to the filtered noise image.

The waveform generated by waveform storage 408 is sent to a display controller 410 and converted to a control signal by the display controller 410. The display controller 410 applies the converted control signal to the physical media. The control signal is applied to the physical media 412 in order to move the particles to their appropriate states to achieve the desired image. The control signal generated by the display controller 410 is applied at the appropriate voltage and for the determined amount of time in order to drive the physical media 412 to a desired state.

For a traditional display like a CRT or LCD, the input image could be used to select the voltage to drive the display, and the same voltage would be applied continuously at each pixel until a new input image was provided. In the case of displays with state, however, the correct voltage to apply depends on the current state. For example, no voltage need be applied if the previous image is the same as the desired image. However, if the previous image is different than the desired image, a voltage needs to be applied based on the state of the current image, a desired state to achieve the desired image, and the amount of time to reach the desired state. For example, if the previous image is black and the desired image is white, a positive voltage may be applied for some length of time in order to achieve the white image, and if the previous image is white and the desired image is black, a negative voltage may be applied in order to achieve the desired black image. Thus, the display controller 410 in FIG. 4 uses the information in the current desired image buffer 404 and the previous image buffer 406 to select a waveform 408 to transition the pixel from current state to the desired state.

According to some embodiments, it may require a long time to complete an update. Some of the waveforms used to reduce the ghosting problem are very long and even short waveforms may require 300 ms to update the display. Because it is necessary to keep track of the optical state of a pixel to know how to change it to the next desired image, some controllers do not allow the desired image to be changed during an update. Thus, if an application is attempting to change the display in response to human input, such as input from a pen, mouse, or other input device, once the first display update is started, the next update cannot begin for 300 ms. New input received immediately after a display update is started will not be seen for 300 ms, this is intolerable for many interactive applications, like drawing, or even scrolling a display.

With most current hardware there is no way to directly read the current reflectance values from the image reflectance 414; therefore, their values can be estimated using empirical data or a model of the physical media 412 of the display characteristics of image reflectance 414 and knowledge of previous voltages that have been applied. In other words, the update process for image reflectance 414 is an open-loop control system.

The control signal generated by the display controller 410 and the current state of the display stored in the previous image buffer 406 determine the next display state. The control signal is applied to the physical media 412 in order to move the particles to their appropriate states to achieve the desired image. The control signal generated by the display controller 410 is applied at the appropriate voltage and for the determined amount of time in order to drive the physical media 412 to a desired state. The display controller 410 determines the sequence of control signals to apply in order to produce the appropriate transition from one image to the next. The transition effect is displayed accordingly on the image reflectance 414 and visible by a human observer through the physical display 416.

In some embodiments, the environment the display is in, in particular the lighting, and how a human observer views the reflectance image 414 through the physical media 416 determine the final image 418. Usually, the display is intended for a human user and the human visual system plays a large role on the perceived image quality. Thus some artifacts that are only small differences between desired reflectance and actual reflectance can be more objectionable than some larger changes in the reflectance image that are less perceivable by a human. Some embodiments are designed to produce images that have large differences with the desired reflectance image, but better perceived images. Half-toned images are one such example.

Illustrations of Technique

Figure 5:
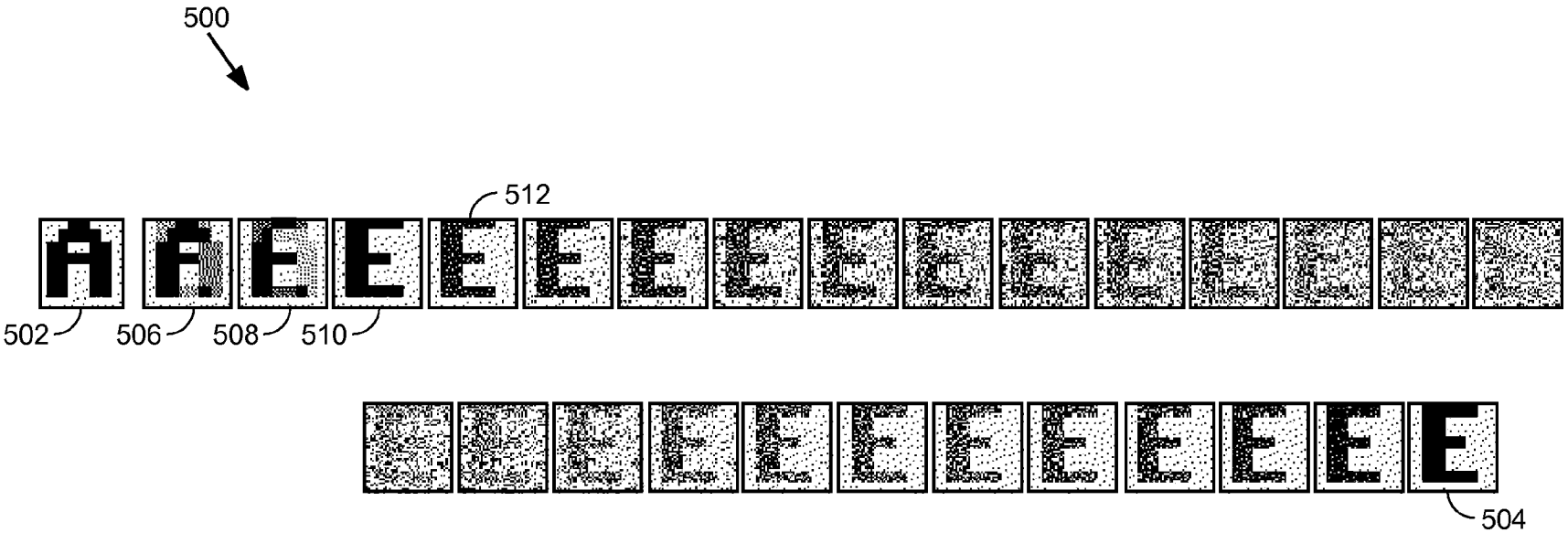
FIG. 5 illustrates a visual representation of a method for updating a bi-stable display in accordance with some embodiments.

FIG. 5 illustrates a visual representation 500 of a method for updating a bi-stable display in accordance with some embodiments. The visual representation 500 depicts a series of display outputs that would be displayed on the display of a bi-stable display during the method 300 for updating the bi-stable display. The visual representation 500 shows an initial image 502 and final image 504 that are displayed on the display of an electronic paper display in some embodiments. Intermediate image 506 to intermediate image 508 illustrates the occurrence of the direct update, where the pixels of the display are driven directly from the current reflectance to a value close to their desired reflectance. Intermediate image 512 to final image 504 illustrates the occurrence of the deghosting update. The result is less "ghosting" artifacts being displayed when a new image is updated on the display screen, without the undesirable and interruptive effect when transitioning from one image to the next.

Upon reading this disclosure, those of skill in the art will appreciate still additional alternative structural and functional designs for a system and a process for updating electronic paper displays through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A method for updating an image on a bi-stable display, comprising:

determining a plurality of differing first sequences of control signals for driving a plurality of pixels of the bi-stable display from a current state toward a first state; and for at least a set of pixels of the plurality of pixels of the bi-stable display, choosing a second sequence of control signals for the set of pixels, applying a label from a plurality of labels to each pixel in the set of pixels, each label associated with a time offset, each label being randomly selected, applying the time offset associated with the randomly selected label to each pixel in the set of pixels to increase a chance of making a first time offset for a first pixel in the set of pixels differ from time offsets for neighboring pixels in the set of pixels and applying the second sequence of control signals to the set of pixels according to different time offsets randomly selected for each pixel in the set of pixels, wherein the chosen second sequence of control signals for the set of pixels produces a transition effect while driving the set of pixels to a second state.

2. The method of claim 1, wherein the plurality of differing first sequences is generated from a single sequence by inserting zero or more frames specifying that no voltage should be applied.

3. The method of claim 1, wherein the second sequence applied to the set of pixels is stochastically selected from a set of possible sequences.

4. The method of claim 1, wherein the second sequence applied to the set of pixels is chosen based, at least in part, on the location of the pixel in the display.

5. The method of claim 1, wherein the second sequence applied to the set of pixels is chosen based, at least in part, on a plurality of filtered-noise algorithms.

6. The method of claim 1, wherein the transition effect starts at the bottom of the bi-stable display and moves toward the top of the bi-stable display.

7. The method of claim 1, wherein the transition effect starts at the top of the bi-stable display and moves toward the bottom of the bi-stable display.

8. The method of claim 1, wherein the transition effect starts at the right side of the bi-stable display and moves toward the left side of the bi-stable display.

9. The method of claim 1, wherein the transition effect starts at one corner of the bi-stable display and moves toward the opposite corner of the bi-stable display.

10. A system for updating an image on a bi-stable display, comprising:

means for determining a plurality of differing first sequences of control signals for driving a plurality of pixels of the bi-stable display from a current state toward a first state; and for at least a set of pixels of the plurality of pixels of the bi-stable display, means for choosing a second sequence of control signals for the set of pixels, applying a label from a plurality of labels to each pixel in the set of pixels, each label associated with a time offset, each label being randomly selected, applying the time offset associated with the randomly selected label to each pixel in the set of pixels to increase a chance of making a first time offset for a first pixel in the set of pixels differ from time offsets for neighboring pixels in the set of pixels and applying the second sequence of control signals to the set of pixels according to different time offsets randomly selected for each pixel in the set of pixels wherein the chosen second sequence of control signals for the set of pixels produces a transition effect while driving the set of pixels to a second state.

11. The system of claim 10, wherein the plurality of differing first sequences is generated from a single sequence by inserting zero or more frames specifying that no voltage should be applied.

12. The system of claim 10, wherein the second sequence applied to the set of pixels is stochastically selected from a set of possible sequences.

13. The system of claim 10, wherein the second sequence applied to the set of pixels is chosen based, at least in part, on the location of the pixel in the display.

14. The system of claim 10, wherein the second sequence applied to the set of pixels is chosen based, at least in part, on a plurality of filtered-noise algorithms.

15. The system of claim 10, wherein the transition effect starts at the bottom of the bi-stable display and moves toward the top of the bi-stable display.

16. The system of claim 10, wherein the transition effect starts at the top of the bi-stable display and moves toward the bottom of the bi-stable display.

17. The system of claim 10, wherein the transition effect starts at the right side of the bi-stable display and moves toward the left side of the bi-stable display.

18. The system of claim 10, wherein the transition effect starts at one corner of the bi-stable display and moves toward the opposite corner of the bi-stable display.

19. An apparatus for updating an image on a bi-stable display, comprising:

a first module for determining a plurality of differing first sequences of control signals for driving a plurality of pixels of the bi-stable display from a current state toward a first state; and for at least a set of pixels of the plurality of pixels of the bi-stable display, a second module for choosing a second sequence of control signals for the set of pixels, applying a label from a plurality of labels to each pixel in the set of pixels, each label associated with a time offset, each label being randomly selected, applying the time offset associated with the randomly selected label to each pixel in the set of pixels to increase a chance of making a first time offset for a first pixel in the set of pixels differ from time offsets for neighboring pixels in the set of pixels and applying the second sequence of control signals to the set of pixels according to different time offsets randomly selected for each pixel in the set of pixels, wherein the chosen second sequence of control signals for the set of pixels produces a transition effect while driving the set of pixels to a second state.

20. The apparatus of claim 19, wherein the plurality of differing first sequences is generated from a single sequence by inserting zero or more frames specifying that no voltage should be applied.

21. The apparatus of claim 19, wherein the second sequence applied to the set of pixels is stochastically selected from a set of possible sequences.

22. The apparatus of claim 19, wherein the second sequence applied to the set of pixels is chosen based, at least in part, on the location of the pixel in the display.

23. The apparatus of claim 19, wherein the second sequence applied to the set of pixels is chosen based, at least in part, on a plurality of filtered-noise algorithms.

24. The apparatus of claim 19, wherein the transition effect starts at the bottom of the bi-stable display and moves toward the top of the bi-stable display.

25. The apparatus of claim 19, wherein the transition effect starts at the top of the bi-stable display and moves toward the bottom of the bi-stable display.

26. The apparatus of claim 19, wherein the transition effect starts at the right side of the bi-stable display and moves toward the left side of the bi-stable display.

27. The apparatus of claim 19, wherein the transition effect starts at one corner of the bi-stable display and moves toward the opposite corner of the bi-stable display.

28. An apparatus for updating an image on a bi-stable display, comprising:

a first module for determining a first sequence of control signals to drive the bi-stable display from a current state toward a first state, wherein the first sequence of control signals is chosen based, in part, on control signals to be applied to neighboring pixels; and a second module for applying a label from a plurality of labels to each pixel in a set of pixels in the bi-stable display, each label associated with a time offset, each label being randomly selected, applying the time offset associated with the randomly selected label to each pixel in the set of pixels to increase a chance of making a first time offset for a first pixel in the set of pixels differ from time offsets for neighboring pixels in the set of pixels, applying the first sequence of control signals according to different time offsets randomly selected for each pixel in the bi-stable display to drive the bi-stable display to produce a transition effect before driving the bi-stable display to a second state.

* * * * *